United States Patent [19]

Cosentino, Jr.

[11] Patent Number: 4,685,439

[45] Date of Patent: Aug. 11, 1987

[54] AUTOMATICALLY-RELEASED ARROW HOLDER

[76] Inventor: Victor A. Cosentino, Jr., 524 New Jersey Ave., Bricktown, N.J. 08723

[21] Appl. No.: 766,584

[22] Filed: Aug. 19, 1985

[51] Int. Cl.[4] ..... F41D 10/00

[52] U.S. Cl. ..... 124/41 A; 124/DIG. 1

[58] Field of Search ..... 124/41 A, 41 R, 23 R, 124/90, 35 A, 37, 88

[56] References Cited

U.S. PATENT DOCUMENTS

| | | | |
|---|---|---|---|
| 4,038,960 | 8/1977 | Ludwig | 124/41 A |
| 4,407,261 | 10/1983 | Elliott | 124/41 A |
| 4,453,528 | 8/1984 | Eckert | 124/41 A |
| 4,542,732 | 9/1985 | Troncoso | 124/90 |

*Primary Examiner*—Richard C. Pinkham
*Assistant Examiner*—Gary Jackson
*Attorney, Agent, or Firm*—Charles F. Gunderson

[57] ABSTRACT

A device for holding an arrow in a ready position against an arrow rest and nocked against the outer cable of a compound bow that is secured to the bow by a bracket mounted above the handle of the bow, adjacent to the arrow rest. A holder arm has one end connected to one end of a shaft pivotably mounted on the bracket. The other end of the holder arm includes an arrow holder to secure the arrow, ready for shooting in one position, and release it for actual shooting in another position. The other end of the shaft is connected to a lever arm that controls the arrow holder and its arm. A string connected between a point on the inner bow cables of the compound bow and the lever arm controlling the holder arm to pull the lever arm to move the arrow holder from the one position to the other position, automatically, when the outer bow cable is drawn to shoot the bow.

1 Claim, 4 Drawing Figures

AUTOMATICALLY-RELEASED ARROW HOLDER

BACKGROUND OF THE INVENTION

Bows and arrows have been with us for many milleneums; first as a weapon, probably for hunting, but inevitably for battle, even into the nineteenth century. After they were replaced as a primary weapon by guns and the like, they still retained their usefulness for limited hunting, and, sporadically, they became popular for target shooting, as a sport.

The original bows were of wood, and with man's inherent ingenuity, various types of wood were experimented with, and certain types of woods were chosen to provide improved flexibility and strength for the constantly-improved range and accuracy, and for the most consistent results. Also the bows varied in size and shape to acomodate their intended use. The short bows of the Tartar horsemen were most effective from horseback and at short range. The legendary english longbow with its "cloth-yard" arrow was superior in range and accuracy for a standing archer.

The development of bows continued over many centuries. However, the bow, as with everything else in our culture, also responded to new materials and developments. Metals, and the newer reenforced plastics provided stronger and lighter materials for the bows, and compound actions for the bow strings or cables made the newer bows more compact and versatile. Improved sighting devices and techniques also improved the accuracy.

As a result of the considerable improvements in bows, and particularly in recent years, the bow has come back as an alternate weapon for hunting. in fact, we now have separate seasons set aside solely for bow hunting, and some of the modern bows are as effective, and almost as accurate as the conventional guns.

However, one of the awkward problems, particularly in hunting with a bow, is keeping the bow and arrow at the ready. When game is sighted, usually after many hours or days of stalking, there is often only fractions of a second to aim and shoot at a startled specimen of game. The problem is keeping one end of the arrow nocked against the string, and at the same time holding the body of the arrow on the arrow rest above the handle of the bow while the bow and arrow are carried for an unpredictable length of time.

The arrow could be held by a finger, but for hours of stalking, this is not practical, feasible, or workable. Many hunters, presumeably, will have developed ways of holding the arrow in a nocked condition and releasing it before drawing the bow string and releasing an arrow, but this takes time, and even a fraction of a second can make a difference in the possibility of hitting a target that can accelerate in the same span of time.

It is therefore an object of this invention to provide a device that can hold an arrow, indefinitely, in a nocked position, on the arrow rest, ready to shoot, and that automatically frees the arrow for shooting as soon as the string or cable is drawn back for shooting. It is a further object of this invention to provide a simple, effective device that holds an arrow in its shooting position on a bow, yet releases it, automatically, as soon as the bow is drawn, for firing in the usual manner. These and other objects will be realized by the device described in detail in the following specification and claims.

SUMMARY OF THE INVENTION

A device is described for attachment to a typical one of the existing compound action bows wherein a holder arm with an arrow holder may be positioned to hold a nocked arrow, in an un-drawn bow, firmly in its arrow rest, against the bow, just above the handle of the bow in a shooting position. The action of drawing the bow cable moves all of the elements of the compound cable away from the handle of the bow, and pulls a string attached to a portion of the compound cables to disengage the holder arm and arrow holder so that the arrow can be fired without impediment. The holder arm can be manually set to hold an arrow firmly against an arrow rest, and can hold the arrow indefinitely, but since the cables must be drawn to shoot the bow, the arrow must be automatically released before shooting.

DETAILED DESCRIPTION OF THE DRAWINGS

Figure 1:
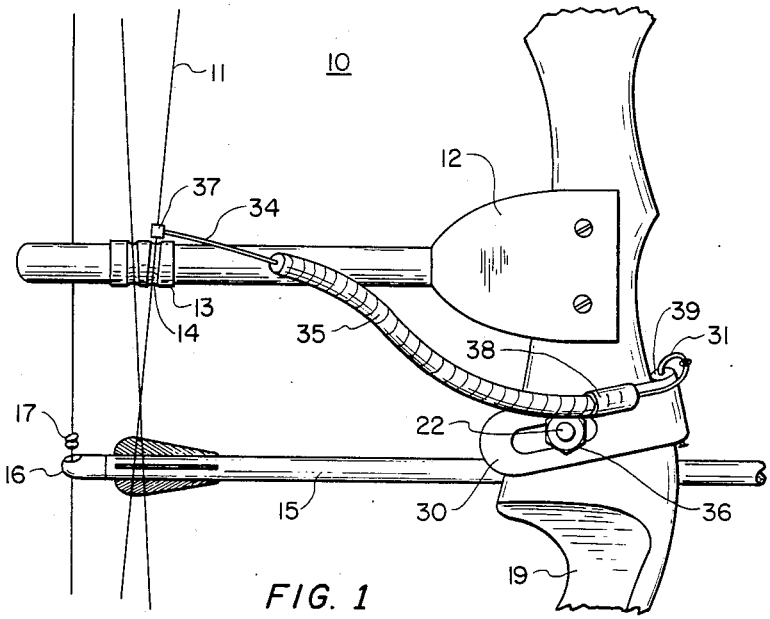
FIG. 1 shows a view of a part of the right-hand side of a typical device with the bow-cables at rest.

Referring now more particularly to FIG. 1, a side view is shown of the central portion 10 of a bow including an arrow holder and its automatic release. This portion includes bow cables or strings 11 of a compound bow action. A cable guard 12 is a standard element of a typical compound bow action and may include a cable guard slide 13 which would have cable slots 14, to control and protect the inner cables of the compound action. An arrow 15 is positioned on the other side of the bow, for a right-handed archer, and a nock 16 is aligned with a nock-locater ferule 17 on the outer cable. The tip of the arrow (18 in FIGS. 2–4) would be out of the picture, and is not shown here.

This figure shows an arrow holder and automatic release device with its bracket 30 fastened to the bow just above a handle 19 by means of a mounting bracket nut 36. In this device, a lever arm 31 couples to a holder arm that includes a holder that will be seen in the other figures. A lever-arm draw string 34 has one end attached to the lever arm 31 and passes through a protective tube or sleeve 35 as a string guide. The other end of the draw string 34 may be attached to an inner portion of one of the compound cables by means of a ferrule 37, similar to the nock-locater ferrule 17. The protective string guide 35 is supported on the bracket by a clamp 38 that is a part of the bracket 30, that also includes a lever-arm pivot slot 39 to support and control the movement of the lever and holder arms.

Figure 2:
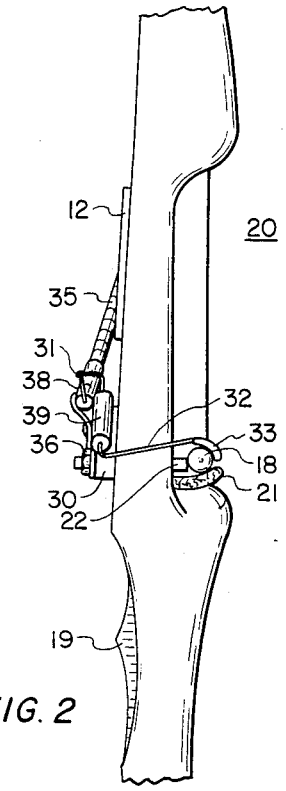
FIG. 2 shows a front view of the device of FIG. 1

FIG. 2 shows a front view of the portion of the device of FIG. 1 with the bow cables at rest. Similar elements are similarly numbered, and the cable guard is seen attached to the bow along with the portions of the arrow holder 30 from this angle. This view shows, more clearly, the window 20 of the arrow aiming and shooting portion of the bow, with its arrow rest 21 supporting and guiding the arrow, whose tip 18 would be seen from this angle. Here the holder arm 32 has been manually depressed to engage the holder 33 against the arrow.

Figure 3:
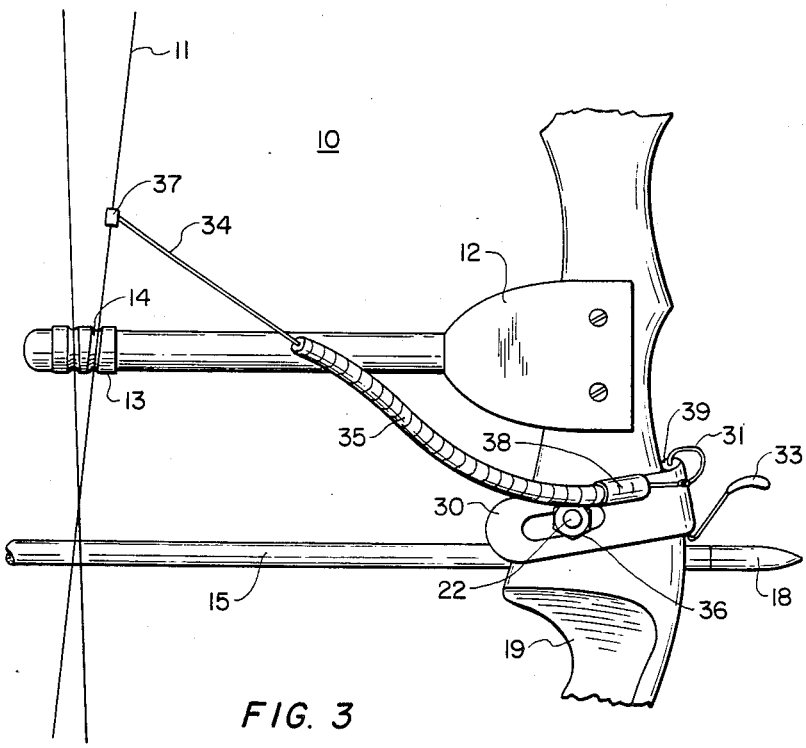
FIG. 3 shows a view of a part of the right-hand side of a typical device with the bow-cables drawn.

FIG. 3 is another side view of the portion of the bow seen in FIG. 1, but with the bow in a drawn condition.

Similar elements are, again, similarly numbered. Here the bow handle 19, along with the cable guard 12 and bracket 30 with its apendages are in place, but the outer portion of the cable that carries the ferrule, along with the nock end of the arrow, would be off the page, and are not shown.

However, the tip 18 of the arrow is now adjacent to the handle, ready to release, and the holder 33 on the holder arm has been drawn back clear of the arrow by the lever arm 31 that is drawn back by the cord 34 through the sleeve 35. Here, again, the cord is attached to one of the inner cable portions of the compound action by means of the ferule 37 that is drawn backwards and upwards, away from the string guide 35, when the outer bow cable and nocked end of the arrow are drawn back for shooting.

Figure 4:
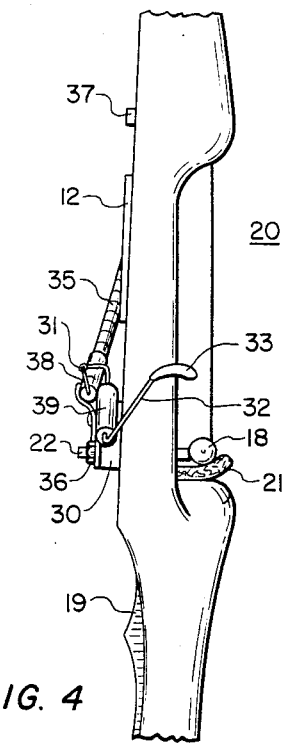
FIG. 4 shows a front view of the device of FIG. 3.

FIG. 4 is a front view of the central portion of the bow and the arrow release of FIG. 3, showing more clearly the holder 33 drawn well away from the arrow by the holder arm 32 that is controlled by the lever arm 31 that is pulled back by the motion of the string 34 as in FIG. 3. The other elements are as in the other figures, and are similarly numbered.

In operation, when the bow is readied for action, and the end of the arrow is nocked under the ferrule 17, the holder arm 32 with holder 33 is pushed down tightly against the shaft of the arrow to hold it tightly against the arrow rest 21. This holds the arrow against lateral motion away from the arrow rest of the bow, and also holds it against axial motion away from the outer bow cable and ferrule. This device is intended to hold the arrow firmly until it is removed manually, or the bow cable is drawn. This pulls the lever arm draw string 34 to pull the lever arm which is directly connected to the holder arm that lifts the holder away from the arrow shaft for unencumbered shooting.

The draw string is shown here connected to a point on the outer cable at 37 that moves backward as well as upward when the cable is drawn. However, it will be apparent, that, if a cable guard slide, such as 13 is provided, the draw string may be attached to the cable guard slide, as long as the lesser motion of the slide is compensated for, if necessary, by a shorter lever arm 31, for example.

The sleeve 35 is to guide and protect the draw string. It may be of any tubular material, and should be somewhat flexible. It should be attached to the bracket 30 by any suitable means such as the clamp 38 to direct one end of the string to the lever arm 31. The lever arm couples directly to the holder arm 32 by means of a shaft through a pivot slot 39 that is also part of the bracket. This slot holds the two arms in either of their two operating positions, but provides enough friction to urge the holder against the arrow to secure it until the bow cable is drawn.

As noted, almost any type of compound bow may be used with this device, with or without the cable guard, although the guard may be helpful in holding the string guide 35.

Since most of these bows have a "burger button" for holding the arrow rest, or other sighting aids, it may be practical to secure the bracket 30 to the bow by securing the mounting bracket nut 36 on the "burger button".

I claim:

1. An automatically-releasable device for holding an arrow in shooting position on a compound action bow comprising a mounting bracket; means for securing said mounting bracket to said bow above the handle portion of said bow and adjacent to an arrow rest, on the other side of said handle from said arrow rest; a holder arm hinged to said bracket, on said other side of said handle; an arrow holder attached to the end of said holder arm, extending around said handle to said arrow rest; said holder arm and, said arrow holder having a first position securing said arrow between said arrow holder and said arrow rest, and a second position with said arrow holder clear of said arrow releasing said arrow for shooting; said compound bow having an outer cable for nocking and shooting said arrow, and inner cables for completing said compound action; a string having one end connected to a given point on said one of said inner cables and means for connecting the other end of said string to said holder arm to draw said holder arm slowly from said first position to said second position when said outer cable is drawn, to automatically release said arrow for shooting, a flexible tubular protective guide surrounding said string; and means for securing said protective guide to said bracket with one end directed toward said given point on said one of said inner cables and another end of said protective guide directed toward said means for connecting said other end of said string to said holder arm.

* * * * *